US005620797A

United States Patent [19]

Mallonee

[11] Patent Number: 5,620,797

[45] Date of Patent: Apr. 15, 1997

[54] POLYPROPYLENE AND POLYESTER CONJUGATE CARPET FACE YARN

[76] Inventor: William C. Mallonee, P.O. Box 2318, Dalton, Ga. 30722

[21] Appl. No.: 523,470

[22] Filed: Sep. 5, 1995

[51] Int. Cl.[6] ..... D02G 3/00; B32B 3/02; C08F 8/00

[52] U.S. Cl. ..... 428/373; 428/374; 428/397; 428/92; 525/177

[58] Field of Search ..... 428/370, 373, 428/374, 397, 92; 525/177

[56] References Cited

U.S. PATENT DOCUMENTS

| | | | |
|---|---|---|---|
| 3,047,383 | 7/1962 | Slayter | 75/201 |
| 3,099,067 | 7/1963 | Merriam et al. | 28/82 |
| 3,137,987 | 6/1964 | Fior et al. | 525/177 |
| 3,312,755 | 4/1967 | Cappuccio et al. | 525/177 |
| 3,359,344 | 12/1967 | Fukushima | 525/177 |
| 3,361,848 | 1/1968 | Siggel et al. | 525/177 |
| 3,373,222 | 3/1968 | Armstrong | 260/857 |
| 3,419,638 | 12/1968 | Fuzek | 525/177 |
| 3,431,322 | 3/1969 | Caldwell et al. | 525/177 |
| 3,900,549 | 8/1975 | Yamane et al. | 525/177 |
| 3,937,757 | 2/1976 | Seydl et al. | 525/177 |
| 4,127,696 | 11/1978 | Okamoto | 428/373 |
| 4,174,358 | 11/1979 | Epstein | 525/183 |
| 4,217,427 | 8/1980 | Falk et al. | 525/177 |
| 4,338,413 | 7/1982 | Coran et al. | 525/179 |
| 4,780,505 | 10/1988 | Mashita et al. | 525/66 |
| 4,782,114 | 11/1988 | Perron et al. | 525/66 |
| 5,108,838 | 4/1992 | Tung | 428/373 |
| 5,445,884 | 8/1995 | Hoyt et al. | 428/373 |
| 5,464,676 | 11/1995 | Hoyt et al. | 428/397 |
| 5,502,160 | 3/1996 | Modrak | 428/373 |

FOREIGN PATENT DOCUMENTS

| | | | |
|---|---|---|---|
| 0286734 | 10/1988 | European Pat. Off. | C08F 255/02 |

*Primary Examiner*—Newton Edwards
*Attorney, Agent, or Firm*—Luedeka, Neely & Graham, P.C.

[57] ABSTRACT

The specification discloses a conjugate carpet face yarn comprising trilobal or delta cross-section polyolefin filaments and a plurality of generally co-linear smaller polyester fibrils embedded within the polyolefin filaments. This yarn has the stain resistant properties of polyolefin based yarns and the resiliency of polyamide based yarns.

12 Claims, 1 Drawing Sheet

POLYPROPYLENE AND POLYESTER CONJUGATE CARPET FACE YARN

FIELD OF THE INVENTION

The invention relates to a carpet face yarn having the stain resistant properties of polyolefin based yarns and the resiliency of polyamide based yarns.

BACKGROUND

Carpets, rugs and mats for home and industrial use are typically made from synthetic or natural fibers such as nylon, polyester, polyolefins, acrylics, rayon, cellulose acetate, cotton and wool. Of the foregoing, synthetic fibers tend to be more commercially acceptable and can be used for a wider variety of applications.

Of the synthetic fibers, nylon has been the polymer of choice for carpets. However, nylon is not without its drawbacks. Notably, nylon carpeting is susceptible to developing static electric charges and thus must be treated to reduce the build-up of static charges. Another disadvantage of nylon carpeting is that it will readily stain. Accordingly, nylon carpets are usually treated to reduce their staining tendencies. These treatments do not, however, prevent all staining, nor do they last for the life of the carpet.

On the other hand, carpets made from polyolefins, such as polypropylene, are very resistant to staining and are naturally antistatic. However, polypropylene is a more rigid and less resilient fiber and will not generally maintain its appearance or shape under prolonged or heavy use, or after repeated deformations.

An object of the invention therefor is to provide an improved carpet face filament.

Another object of the invention is to provide a carpet face filament having the resiliency of polyamide and the stain resistance of polyolefin.

Still another object of the invention is provide a method for producing a carpet face filament which exhibits inherent antistatic properties.

SUMMARY OF THE INVENTION

With regard to the above and other objects, the invention provides a conjugate carpet face yarn comprising trilobal or delta cross-section polyolefin filaments, preferably polypropylene, having a denier in the range of from about 1350 to about 1550 per 72 filaments and a plurality of generally co-linear substantially smaller elongate polyester fibrils, preferably of polyethylene terephthalate, embedded within the polyolefin filaments wherein the polyester fibrils comprise from about 5 to about 40 wt. % of the total filament weight.

It has been found that a polyolefin/polyester matrix filament having a substantially continuous polyolefin phase and, interspersed therein, a substantially discontinuous polyester phase which is concentrated toward the center of the filaments provides in a polyolefin-type carpet yarn what amounts to nylon-type properties in terms of resiliency but without the drawbacks of nylon. That is, the yarn exhibits the good anti-staining properties of polyolefins and their favorable flame retardancy and anti-static properties, but does not matt like polyolefin fibers. The yarn is also less costly to produce than nylon, since polypropylene is about 60% cheaper per pound in the current market than nylon. In addition to the foregoing properties, the conjugate yarn of the invention has a matt finish thus reducing the need for the addition of fillers such as titanium dioxide to decrease the luster of the yarn as is required with pure nylon carpet yarns.

The invention further provides a method for making fiber for a carpet face yarn having the stain resistance of a polyolefin face yarn and the resiliency of a polyamide face yarn. The method comprises blending from about 5 to about 40 wt. % polyester with from about 60 to about 95 wt. % polyolefin to provide a polyester/polyolefin blend. The polyester/polyolefin blend is then fed to a hot melt extruder at a pressure and temperature sufficient to melt the blend and to provide an essentially homogeneous mixture of the immiscible polymers. Once melted and homogeneously mixed, the molten mixture is forced at a shear rate within the range of from about 1000 to about 5000 reciprocal seconds through a spinneret containing a plurality of trilobal or delta capillary openings. The filaments thus produced contain a polyolefin/polyester matrix having a substantially continuous polyolefin phase and a substantially discontinuous polyester phase interspersed in the polyolefin phase with the polyester phase being concentrated generally toward the center of the filaments. The polyester phase is believed to be in the form of fibrils which are produced in-situ in a trilobal or delta cross-section filament wherein the polyester concentration along the length of each filament is substantially constant. Preferred conjugate filaments have a denier ranging from about 1350 to about 1550 per 72 filaments.

DETAILED DESCRIPTION OF THE INVENTION

Figure 1:
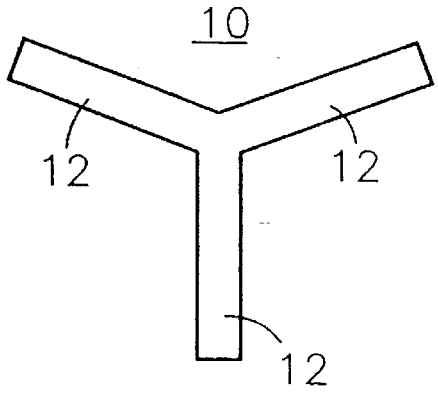
FIG. 1 is an illustration, not to scale, of a preferred spinneret orifice configuration for producing the carpet filaments of the invention.

An important feature of the carpet face yarn of the invention is that it has the resiliency and flame retardance of polyamide yarns such as nylon 6 and nylon 66, yet has the stain resistance of polyolefin yarns such as polypropylene. Furthermore, the trilobal carpet face yarn of the invention is resistant to the formation of a static electric charge common to polyamide carpet yarns.

The polyolefins which may be used to produce the carpet yarn of the invention include, but are not limited to, polyethylene, polypropylene, poly(1-butene), poly(3-methyl-1-butene), poly(4-methyl-1-pentene), and the like as well as combinations or mixtures of two or more of the foregoing. Of the foregoing polyolefins, polypropylene is particularly preferred. One suitable source of polypropylene is the polypropylene available from Shell Chemical Company under the trade name designation NRD5-1263.

Polyester polymers which may be used with the invention include, but are not limited to, the polycondensation products of dicarboxylic acids or anhydrides with dihydric alcohols and mixtures of the polycondensation products. Dicarboxylic acids and anhydrides which may be reacted with the dihydric alcohols include the saturated or unsaturated fatty acids and anhydrides such as maleic, fumaric, phthalic and adipic acids and anhydrides. A particularly preferred dicarboxylic acid or anhydride is phthalic acid or anhydride.

The dihydric alcohols which are reacted with the dicarboxylic acids or anhydrides to provide the polyester polymers include, but are not limited to, the alkylene glycols having from about 2 to about 10 carbon atoms. Preferred dihydric alcohols include ethylene glycol, propylene glycol, diethylene glycol, and dipropylene glycol. Particularly preferred polycondensation products of dicarboxylic acids or anhydrides and dihydric alcohols include polyethylene terephthalate, polybutylene terephthalate and polypropylene terephthalate.

One suitable source of polyester polymer is the polyethylene terephthalate polymer available from Wellman Corporation under the trade name designation PERMACLEAR PET. Another suitable source of polyester polymer is polybutylene terephthalate polymer available from BASF Corporation under the tradename ULTRADUR B 4500.

For imparting flame retardance to the carpet face yarn, one or both of the dicarboxylic acid or anhydride and dihydric alcohols may be halogenated. Halogens which may be used include chlorine, bromine, and fluorine. Halogenated polyester compounds prepared from the halogenated acids or alcohols may also be mixed with other well known halogenated and non-halogenated flame retardants if desired to further increase the flame retardancy of the carpet face yarn. It is preferred that the polymeric mixture used to make the carpet face yarn contain from about 60 to about 95 wt. %, preferably from about 75 to about 85 wt. %, polyolefin and from about 5 to about 40 wt. %, preferably from about 10 to about 20 wt. %, polyester.

The polyolefin and polyester polymers are preferably dry blended prior to feeding the blend to an extruder. In the alternative, the polymers may be fed directly to the extruder in any order provided there is sufficient residence time in the extruder to assure thorough essentially homogeneous mixing of the two polymers. It will be recognized that a preblended essentially homogeneous mixture of polyolefin and polyester may also be fed to an extruder.

Once made, the blend of polyolefin and polyester is melted and extruded under a pressure which provides an essentially homogeneous mixture of the two immiscible polymers. Pressures ranging from about 700 to about 2000 psia (about 4.8 MPa to about 13.8 MPa) are preferably used to obtain a homogeneous mixture of polymers prior to extrusion.

In the extruder, the molten mixture is forced at a temperature within the range of 240° to about 300° C. through a spinneret containing a plurality of trilobal or delta capillary openings. The extruder temperature used is dependant on the viscosity of the polyester in the polyolefin/polyester blend. The higher the viscosity of the polyester, the higher the temperature required for extruding the blend.

Figure 2:
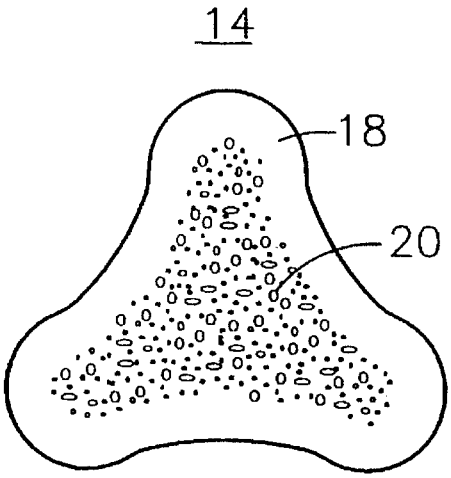
FIGS. 2 and 3 are cross-sectional illustrations, not to scale, of the trilobal or delta conjugate filaments of the invention.
Figure 3:
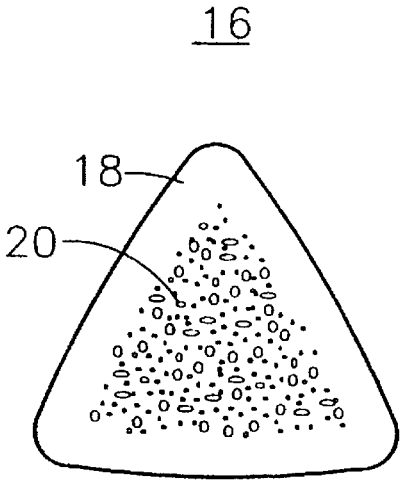

FIG. 1 illustrates a capillary opening 10 for use in producing the filaments of the present invention in a trilobal configuration. The capillary opening 10 has legs 12 of equal length so that the melted mixture flows through the capillary opening 10 in legs 12 thereby increasing the shear rate on the molten mixture and causing the filament to set in a generally trilobal cross-sectional configuration 14 as illustrated in FIG. 2 or a delta cross-sectional configuration 16 as illustrated in FIG. 3. In FIGS. 2 and 3, the polyolefin 18 provides the bulk of the filament with fibrils 20 of polyester dispersed within the filament, generally concentrated toward the center of the filament.

The shear rate of the molten mixture during extrusion is an important factor in practicing the present invention for optimal results. Shear rates in the range of from about 1000 to about 5000 reciprocal seconds are preferred. Particularly preferred is a shear rate within the range of from about 2000 to about 4000 reciprocal seconds, with a shear rate of about 3800 reciprocal seconds being especially preferred. By selecting a plurality of capillary openings having a trilobal arrangement, the desired shear rate for extrusion of the mixture may be obtained.

After spinning, the conjugate filament is drawn one or more times, preferably 3 times, and then texturized with either a hot air jet or a steam jet. Unlike other polymeric materials, spinning, drawing and texturizing of the conjugate filaments in discrete batch operations is not required. Accordingly, the conjugate filaments of the invention may be spun, drawn and texturized essentially continuously without the need for a curing or a waiting period after each step. In the alternative, any two of spinning, drawing and texturizing may be done essentially continuously with a curing or waiting period after the batch step and before the continuous steps.

For purposes of obtaining colored carpet face yarns, the polymers which are combined to make the yarns of the invention may each contain pigments or chemical dyes, or the finished yarn may be dyed. Useful inorganic pigments include, but are not limited to, cadmium mercury, cadmium mercury orange, cadmium sulfide yellow, cadmium sulfoselenide, titanium dioxide, titanium yellow, titanium green, titanium blue, cobalt aluminate, manganese blue, manganese violet, ultramarine red, ultramarine blue, ultramarine violet, and the like. Organic pigments include, but are not limited to, permanent red 2B, perylene red, quinacridone red, diazo orange, diazo yellow, isoindolinone, hansa yellow, phthalocyanine green, phthalocyanine blue, quinacridone violet, doxazine violet, and the like. Chemical dyes include, but are not limited to, the mono- and disulfonated acid dyes, as well as triphenylmethane, pyrazolone, azine, nitro and quinoline dyes. When used, the pigment dyes may be predispersed in the polyolefin masterbatch before the polyolefin and polyester are extruded.

Since pure polyolefin filaments cannot generally be dyed with chemical acid or basic dyes, pigment dyes are typically used to give the polyolefin its color in a process known as "solution dyeing". Solution dyeing results in a permanent color that is highly resistant to staining or fading due to uv light. In contrast to pure polyolefin filaments, the conjugate filaments of the invention may be dyed with disperse dyes in addition to the pigment dyes, and the dyed conjugate filaments of the invention have stain resistant properties similar to pure polyolefin filaments.

A particular advantage of the conjugate filaments of the invention is the synergistic flame retardancy of the filaments. Even though the filaments may contain only about 15 wt. % non-halogenated polyester and no flame retardants, the conjugate filaments of the invention may have about a 45 to 55% increase in flame retardance relative to the flame retardance of pure polyolefin filaments.

When desired, the polyolefin and polyester conjugate filaments of the invention may also contain flame retardants. Flame retardants suitable for use with one or both of the polymers of the invention include, but are not limited to, hexabromocyclododecane, decabromodiphenyl oxide, ethylene-bis(tetrabromophthalimide), ethylene-bis(dibromonorborane dicarboximide), pentabromodiphenyl oxide, ethylene-bis(dibromo-norborane dicarboximide), polydibromophenylene oxide, halogenated phosphate ester, tetrabromophthalic anhydride, bis(tribromophthalic anhydride), tetrabromobisphenol-A bis (2-hydroxyethyl ether), tetrabromobisphenol-A bis(2,3-dibromopropyl ether), and dibromoneopentyl glycol, tetradecabromodiphenoxy benzene, aluminum oxide trihydrated, antimony oxide, sodium antimonate, zinc borate, diacrylate ester of tetrabromobisphenol-A, and the like.

A preferred flame retardant system will generally contain a halogenated organic compound and a flame retardant synergist such as antimony oxide. The total amount of flame retardant in each polymer may range from about 5 to about 15 wt. % of the total weight of conjugate filament. At about 10 wt. % flame retardant, there is often about a 50% increase in flame retardancy as determined by the radiant panel flame retardancy test.

While not desiring to be bound by theoretical considerations, it is believed that the properties of the carpet face yarn of the invention may be due, at least in part, to the production of in-situ polyester fibrils in a matrix of polyolefin. The in-situ fibril formation is due to the immiscibility of the polymers with one another, and the shear forces exerted on the molten mixture in the capillary openings of the extruder. The polyester phase which is discontinuous is concentrated near the center of the capillary openings of the spinneret where the shear forces are the least. As a result, the polyester phase is interspersed in a continuous polyolefin phase which is concentrated near the walls of the capillary openings of the spinneret where the shear forces are the greatest.

Polyester fibrils which are produced by the shear forces in the capillary openings have a diameter in the range of a fraction of a micron to a few microns and a length of several tens of microns whereas the overall cross-sectional length of each side of the trilobal or delta filaments containing the fibrils may range from about 1 to about 3 millimeters.

Since the amount of polyolefin in the mixture is much greater than the amount of polyester, the polyolefin will provide a matrix encapsulating the polyester fibrils. The polyester fibrils provide reinforcing to the polyolefin matrix similar to reinforcing provided by a welt having a semi-rigid inner core. Accordingly, the polyester fibrils improve the resiliency of the yarn over yarn made only with polyolefin polymer.

Another factor which may contribute to the production of fibrils in the center of the filament is the difference in the melt viscosity of the polyolefin and polyester phases. At a shear rate of 3800 reciprocal seconds, polypropylene has a melt viscosity of 240 poises at 280° C. at the capillary wall. The melt viscosity for the same temperature and shear rate for polyester having an intrinsic viscosity of 0.64 is 2600 poises and is 7800 poises for polyester having an intrinsic viscosity of 0.81 at 280° C. Accordingly, the ratio of polyester melt viscosity to polyolefin melt viscosity is typically within the range of from about 10:1 to about 40:1 for producing the conjugate filaments of the invention. The lower polyolefin viscosity will cause the polyolefin to flow much faster through the capillary opening at the walls of the opening where the shear rate is highest while the polyester flows through the sections of the capillary opening away from the walls.

In the following examples, an essentially homogeneous mixture of polyester and polyolefin were obtained in a 1.5 inch single screw multizone extruder operating at a pressure of about 1500 psia (about 10.3 MPa) and having a first zone temperature of about 255° C. A preferred method for obtaining a controlled melting of the polymers within a single screw extruder barrel is by the use of a Davis standard barrier (DSB) mixing screw available from Davis Standard Corporation of Pawcatuck, Conn. as disclosed in U.S. Pat. No. 4,341,474 incorporated herein by reference as if fully set forth. In conjunction with the DSB mixing screw, it is preferred to use a distributive mixing head such as a Union Carbide Corporation (UCC) mixer or a cavity transfer mixer (CTM) as disclosed in U.S. Pat. Nos. 3,486,192 and 4,419,014 incorporated herein by reference as if fully set forth. A particularly preferred multi-zone extruder for obtaining sufficient control of the temperatures in each of the heating zones of the extruder barrel is the THERMATIC single screw extruder available from Davis Standard Corporation of as disclosed in U.S. Pat. No. 5,149,193 incorporated herein by reference as if fully set forth.

EXAMPLE 1

A dry blend mixture of 15 wt. % polyethylene terephthalate chips having an intrinsic viscosity of 0.64 from Wellman Corporation of Johnsonville, S.C. and 85 wt. % polypropylene pellets having a melt index of 12 (NRD5-1263 from Shell Chemical Company) were fed from a feed hopper directly into a 1.5 inch hot melt extruder wherein a homogenous molten mixture was obtained. No color concentrate was added to the molten mixture. The molten mixture was then pumped through a pack of screens to remove any particles greater than 20 microns. The screened mixture was pumped to a spinneret having 72 trilobal capillary openings in order to provide conjugate filaments. Each trilobal capillary had leg lengths of 0.0205 inches and leg widths of 0.008 inches. The extrusion rate was 0.278 pounds per hour per hole at 280° C. thereby producing a shear rate of 3800 reciprocal seconds. Carpet yarn was spun from the filaments in a two-step process. The spinning was done using polyester extrusion conditions at 300 m/min. The filaments were spun at a denier of 4500 per 72 filaments (trilobal) at 280° C. melt temperature to yield a spun yarn denier of 4500. The yarns were then drawn three times at 115° C. and hot air jet texturized at 130° C. The yarn was textured, having a denier of 1500 per 72 filaments. The relaxation ratio of the textured yarn was 0.71:1 and the drawn denier was targeted for 1500 denier with 72 filaments.

EXAMPLE 2

A batch of 100 wt. % nylon 6 chips having a relative viscosity of 2.4 (Type 403 from BASF Corporation) were fed from a feed hopper directly into a 1.5 inch hot melt extruder. The pure nylon 6 batch was made to obtain a control sample of yarn for comparison of physical properties to the polyester and polypropylene mixtures. No color concentrate was added to the molten mixture. The molten mixture was pumped through a pack of screens to remove any particles greater than 20 microns. The screened mixture was fed to a spinneret having 72 trilobal capillary openings in order to produce filaments. Each trilobal capillary had leg lengths of 0.0205 inches and leg widths of 0.008 inches. The extrusion rate was 0.278 pounds per hour per hole at 260° C. thereby producing a shear rate of 3800 reciprocal seconds. Carpet yarns were spun in a one-step process according to the procedure disclosed in Example 1.

EXAMPLE 3

A dry blend mixture of 10 wt. % polyethylene terephthalate chips having an intrinsic viscosity of 0.64 (Wellman Corporation) and 5 wt. % polybutylene terephthalate (ULTRADUR B 4500 from BASF Corporation of Asheville, N.C.) and 85 wt. % polypropylene pellets having a melt index of 12 (NRD5-1263 from Shell Chemical Company of Houston, Tex.) were fed from a feed hopper directly into a 1.5 inch hot melt extruder wherein a homogeneous molten mixture was obtained. Processing conditions as disclosed in Example 1 were used to produce a conjugate fiber of 1500 denier with 72 filaments.

EXAMPLE 4

A dry blend mixture of 15 wt. % polyester flake having an intrinsic viscosity of 0.81 from Barrex Corporation of Charlotte, N.C. and 85 wt. % polypropylene pellets having a melt index of 12 (NRD5-1263 from Shell Chemical Company) were fed from a feed hopper directly into a 1.5 inch hot melt extruder wherein a homogenous molten mixture was obtained. The polyester flake was obtained from reclaimed polyester bottles. No color concentrate was added to the molten mixture. The molten mixture was then pumped through a pack of screens to remove any particles greater than 20 microns. The screened mixture was pumped to a spinneret having 72 trilobal capillary openings in order to produce conjugate filaments. Each trilobal capillary had leg lengths of 0.0205 inches and leg widths of 0.008 inches. The extrusion rate was 0.278 pounds per hour per hole at 280° C. thereby producing a shear rate of 3800 reciprocal seconds. Carpet yarn was spun from the filaments in a two-step process. The spinning was done using polyester extrusion conditions at 300 m/min. The filaments were spun at a denier of 4500 per 72 filaments (trilobal) at 280° C. melt temperature to yield a spun yarn denier of 4500. The yarns were then drawn three times at 115° C. and hot air jet texturized at 130° C. The yarn was textured, having a denier of 1500 per 72 filaments. The relaxation ratio of the textured yarn was 0.71:1 and the drawn denier was targeted for 1500 denier with 72 filaments.

For all of the above examples, hot air shrinkage percentages were determined at 140° C. after 10 minutes measured under 0.02 gpd. comparisons of the yarns of Examples 1–4 are given in Table 1.

TABLE 1

| Description | Denier (gms) | Tenacity (gpd) | Elongation (%) | Crimp (%) | Shrinkage (%) |
|---|---|---|---|---|---|
| 100 wt. % NRD5-1263 | 1480 | 2.1 | 46 | 2.14 | 14 |
| 100 wt. % Nylon 6 | 1517 | 2.3 | 50 | 2.95 | 24 |
| 15 wt. % PET (0.64 IV), 85 wt. % NRD5-1263 | 1488 | 2.5 | 66 | 2.79 | 21 |
| 15 wt. % PET (0.81 IV), 85 wt. % NRD5-1263 | 1530 | 1.8 | 70 | 2.63 | 19 |
| 10 wt. % PET (0.64 IV), 5 wt. % PBT, 85 wt. % NRD5-1263 | 1500 | 2.1 | 92 | 3.03 | 24 |

As compared to polypropylene without polyester reinforcement, the conjugate carpet yarn containing polyester fibrils had an increase in elongation, crimp, and fiber shrinkage. Surprisingly, the tenacity, crimp and fiber shrinkage of the polyester/polypropylene conjugate yarn were comparable to that of pure nylon yarn, while the elongation of the conjugate yarn was much higher.

In order to test the characteristics of carpet made from the yarn, the 1500 denier filaments were two-ply twisted and heat set. The twisting was 4.50×4.50 tpi and the heat set was done on a Superba Stuffer Box at a tunnel temperature of 132° C. To make a carpet from the yarn of the invention the filaments were broadloom tufted in 34 ounce cut pile (⅛ gauge, 9 stitches per inch, 15/32 inch pile height) on a latex substrate with secondary backing. Floor rating, flame retardance, stain rate and static electricity generation were then measured on the conjugate carpet yarns of the invention and were compared to 100 wt. % polypropylene and 100 wt. % nylon carpets. The results are given in Table 2.

TABLE 2

| Description | Floor Rating (CRI visual) | Radiant Panel (watts/cm$^2$) | Stain Rate[1] | Floor Static (KV) |
|---|---|---|---|---|
| 100 wt. % NRD5-1263 | 1.8 | 0.22 | 5 | 1.3 |
| 100 wt. % Nylon 6 | 3.0 | 0.63 | 1–2 | 4.1 |
| 15 wt. % PET (0.64 IV), 85 wt. % NRD5-1263 | 2.7 | 0.34 | 4–5 | 1.1 |
| 15 wt.% PET (0.81 IV), 85 wt. % NRD5-1263 | 2.5 | 0.32 | 4–5 | 1.5 |

[1]Stain Rate-American Association of Textile Colorists and Chemists (AATCC) Grey Scale method for Staining and color change.

As illustrated by the foregoing samples, the conjugate polypropylene/polyester carpets had a floor rating 39 to 50% higher than pure polypropylene carpet even though the conjugate carpets contained only 15 wt. % polyester. Likewise the conjugate carpet of the invention had a synergistic increase in flame retardancy over that of pure polypropylene in the absence of any added flame retardants as determined by the radiant panel test. Pure polyester carpet typically has a flame retardancy of about 0.45 to about 0.55 watts/cm$^2$. In terms of flame spread, the conjugate carpet of the invention passed the pill test 8 out of 8 times and the smoke density of the conjugate carpet was 300.

The stain rate of the polypropylene/polyester carpet of the invention is comparable to that of pure polypropylene carpet and significantly better than that of pure nylon carpet.

Static electricity generation was evaluated by the AATCC-134 method using neolite soles at 20% relative humidity at 70 degrees fahrenheit. The maximum threshold limit of static electricity for human comfort is 3.5 kilovolts. None of the tested carpet samples were treated for static dissipation by use of a antistatic finish or antistatic carbon fibers. As illustrated above, the 100 wt. % nylon sample had an unacceptably high static electricity generation, whereas all of the other samples were virtually static electricity free.

Accordingly, the 15 wt. % PET conjugate filaments were significantly better than 1004 polypropylene (NRD5-1263) in terms of flame retardancy and resiliency and comparable to the 100% polypropylene in terms of static electricity generation while the PET/PP conjugate filaments rate comparable to the 1004 nylon 6 sample in terms of flame retardance and resiliency.

The dyeability of the conjugate fibers of the invention as compared to 100 wt. % nylon 6 yarn was shown in the following examples. In these samples, yellow, red and blue disperse dyes were used at various concentrations for dyeing the conjugate yarns and acid dyes were used for dyeing the 100 wt. % nylon 6 yarns. The dyeability results are given in Table 3.

TABLE 3

| Sample Description | Sample No. | Dye (wt. %) | Color[1] |
|---|---|---|---|
| 100 wt. % Nylon 6 | A1 | 0.25 | Yellow #199 |
| | A2 | 1.00 | Yellow #199 |
| | A3 | 0.25 | Red |
| | A4 | 1.00 | Red |
| | A5 | 0.25 | Blue #324 |
| | A6 | 1.00 | Blue #324 |
| **Sample Description** | **Sample No.** | **Dye (wt. %)** | **Color[2]** |
| 15 wt. % PET (0.64 IV), 85 wt. % NRD5-1263 | B1 | 0.25 | Yellow #54 |
| | B2 | 2.00 | Yellow #54 |
| | B3 | 0.25 | Yellow #64 |
| | B4 | 2.00 | Yellow #64 |
| | B5 | 0.25 | Red #60 |
| | B6 | 2.00 | Red #60 |
| | B7 | 0.25 | Blue #87 |
| | B8 | 2.00 | Blue #87 |
| | B9 | 0.25 | Blue #60 |
| | B10 | 2.00 | Blue #60 |
| 15 wt. % PET (0.81 IV), 85 wt. % NRD5-1263 | C1 | 0.25 | Yellow #54 |
| | C2 | 2.00 | Yellow #54 |
| | C3 | 0.25 | Yellow #64 |
| | C4 | 2.00 | Yellow #64 |
| | C5 | 0.25 | Red #60 |
| | C6 | 2.00 | Red #60 |
| | C7 | 0.25 | Blue #87 |
| | C8 | 2.00 | Blue #87 |
| | C9 | 0.25 | Blue #60 |
| | C10 | 2.00 | Blue #60 |

TABLE 3-continued

| | | | |
|---|---|---|---|
| 10 wt. % PET (0.64 IV), 5 wt. % PBT and 85 wt. % NRD5-1263 | D1 | 0.25 | Yellow #54 |
| | D2 | 2.00 | Yellow #54 |
| | D3 | 0.25 | Yellow #64 |
| | D4 | 2.00 | Yellow #64 |
| | D5 | 0.25 | Red #60 |
| | D6 | 2.00 | Red #60 |
| | D7 | 0.25 | Blue #87 |
| | D8 | 2.00 | Blue #87 |
| | D9 | 0.25 | Blue #60 |
| | D10 | 2.00 | Blue #60 |

[1]Color-The acid dyes which were used are available from Crompton & Knowles of Gibralta, Pennsylvania.
[2]Color-The disperse dyes which were used are available from Crompton & Knowles of Gibralta, Pennsylvania.

As illustrated by the samples of Table 3, the conjugate yarns of the invention were readily disperse dyed even without the use of carriers for the dyes. Conventionally, carriers are required in order to obtain deeper dye shades for disperse dyeing of polyester yarns. However, even without the use of carriers, the yarns of the invention obtained acceptable shades for yellow, red and blue disperse dyes.

The color fastness of the dyed yarn samples of Table 3 were compared to the color fastness of 100 wt. % nylon yarn using a cold water bleed test, high humidity (H.H.) ozone fade, $NO_2$ gas fade and 40 hour xenon light fastness tests. The results are given in Table 4 and are based on the AATCC grey scale for staining and color change.

TABLE 4

| | | 107 Cold Water Bleed Test | | | | | | 1 Cycle H.H. Ozone | 1 Cycle $NO_2$ gas | 40 Hrs. Xenon Light |
|---|---|---|---|---|---|---|---|---|---|---|
| Sample | No. | acetate | cotton | nylon | dacron | orlon | wool | Fade | Fade | Fastness |
| 100 wt. % Nylon 6 | 1A | 5 | 5 | 4–5 | 5 | 5 | 5 | 5 | 5 | 5 |
| | 2A | 4–5 | 4–5 | 3–4 | 5 | 5 | 4–5 | 5 | 5 | 5 |
| | 3A | 5 | 5 | 4 | 5 | 5 | 5 | 5 | 5 | 5 |
| | 4A | 5 | 5 | 3 | 5 | 5 | 4 | 5 | 5 | 5 |
| | 5A | 5 | 5 | 4 | 5 | 5 | 4-5 | 5 | 5 | 5 |
| | 6A | 4–5 | 4–5 | 3 | 5 | 5 | 4 | 5 | 5 | 5 |
| 15 wt. % PET (0.64 IV), 85 wt. % PP NRD5-1263 | 1B | 5 | 5 | 5 | 5 | 5 | 5 | 5 | 5 | 5 |
| | 2B | 4–5 | 4–5 | 4–5 | 4–5 | 5 | 4–5 | 5 | 5 | 5 |
| | 3B | 5 | 5 | 5 | 5 | 5 | 5 | 5 | 5 | 5 |
| | 4B | 4 | 4–5 | 4 | 4–5 | 4–5 | 4–5 | 5 | 5 | 5 |
| | 5B | 5 | 5 | 5 | 4 | 5 | 5 | 5 | 5 | 4–5 |
| | 6B | 4–5 | 5 | 4–5 | 5 | 5 | 5 | 5 | 5 | 4–5 |
| | 7B | 5 | 5 | 5 | 5 | 5 | 5 | 5 | 5 | 5 |
| | 8B | 5 | 5 | 4–5 | 5 | 5 | 5 | 5 | 5 | 4–5 |
| | 9B | 5 | 5 | 5 | 5 | 5 | 5 | 5 | 5 | 5 |
| | 10B | 5 | 5 | 5 | 5 | 5 | 5 | 5 | 5 | 5 |
| 15 wt. % PET (0.81 IV), 85 wt. % PP NRD5-1263 | 1C | 5 | 5 | 5 | 5 | 5 | 5 | 5 | 5 | 5 |
| | 2C | 4–5 | 4–5 | 4–5 | 4–5 | 5 | 5 | 5 | 5 | 5 |
| | 3C | 5 | 5 | 5 | 5 | 5 | 5 | 5 | 5 | 5 |
| | 4C | 4 | 4–5 | 4 | 4–5 | 5 | 4–5 | 5 | 5 | 5 |
| | 5C | 5 | 5 | 5 | 5 | 5 | 5 | 5 | 5 | 4 |
| | 6C | 4 | 4–5 | 4 | 4–5 | 5 | 4–5 | 5 | 5 | 5 |
| | 7C | 5 | 5 | 5 | 5 | 5 | 5 | 5 | 5 | 5 |
| | 8C | 4–5 | 5 | 4–5 | 5 | 5 | 5 | 5 | 5 | 5 |
| | 5C | 5 | 5 | 5 | 5 | 5 | 5 | 5 | 5 | 5 |
| | 10C | 5 | 5 | 5 | 5 | 5 | 5 | 5 | 5 | 5 |
| 10 wt. % PET (0.64 IV), 5 wt. %; PBT and 85 wt. % PP NRD5-1263 | 1D | 4–5 | 5 | 4–5 | 5 | 5 | 5 | 5 | 5 | 5 |
| | 2D | 4 | 4–5 | 4 | 4–5 | 5 | 4–5 | 5 | 5 | 5 |
| | 3D | 4–5 | 5 | 4–5 | 5 | 5 | 5 | 5 | 5 | 5 |
| | 4D | 4 | 4–5 | 4 | 4–5 | 5 | 4–5 | 5 | 5 | 5 |
| | 5D | 5 | 5 | 5 | 5 | 5 | 5 | 5 | 5 | 4 |
| | 6D | 4–5 | 5 | 4–5 | 5 | 5 | 5 | 5 | 5 | 5 |
| | 7D | 5 | 5 | 5 | 5 | 5 | 5 | 5 | 5 | 5 |
| | 8D | 5 | 5 | 5 | 5 | 5 | 5 | 5 | 5 | 5 |
| | 9D | 5 | 5 | 5 | 5 | 5 | 5 | 5 | 5 | 5 |

TABLE 4-continued

| Sample | No. | 107 Cold Water Bleed Test acetate | cotton | nylon | dacron | orlon | wool | 1 Cycle H.H. Ozone Fade | 1 Cycle $NO_2$ gas Fade | 40 Hrs. Xenon Light Fastness |
|---|---|---|---|---|---|---|---|---|---|---|
| | 10D | 5 | 5 | 5 | 5 | 5 | 5 | 5 | 5 | 5 |

As illustrated by the above examples, the conjugate yarns of the invention had equivalent color fastness to nylon 6 and slightly better cold water bleed. The nylon 6 yarns bled on nylon in the cold water bleed test while the conjugate yarns of the invention did not bleed on any fabric.

The production of polyester fibrils within the polypropylene matrix was confirmed by observation of the filaments under a magnification of 400 X using polarized light. The differences in fibril characteristics between high and low intrinsic viscosity polyester fibrils (Examples 1 and 3 respectively) are contained in the following Tables 5 and 6 for smaller and larger size fibrils.

TABLE 5

| Smaller Size Fibrils | Length (L) | Diameter (D) | Ratio (L/D) |
|---|---|---|---|
| Low Viscosity PET (0.64 IV) | 68 | 3.8 | 18 |
| High Viscosity PET (0.81 IV) | 38 | 3.0 | 13 |

TABLE 6

| Larger Size Fibrils | Length (L) | Diameter (D) | Ratio (L/D) |
|---|---|---|---|
| Low Viscosity PET (0.64 IV) | 790 | 2.0 | 395 |
| High Viscosity PET (0.81 IV) | 410 | 1.6 | 256 |

As illustrated in Tables 5 and 6, the high viscosity PET (bottle reclaim grade) conjugate fibers had a fibril length which was about 45% less than that of the lower viscosity PET conjugate fibers. Likewise the diameters and L/D ratios of the higher viscosity PET conjugate fibers were lower than that of the lower viscosity PET conjugate fibers.

The conjugate yarns of the invention have a naturally matt finish whereas, without the addition of fillers such as titanium dioxide whereas pure nylon face yarns have a shiny finish and require the addition of fillers to reduce the gloss of the carpet fibers. Since there is no need to add fillers to the conjugate yarn of the invention production costs for the conjugate yarn may be minimized.

While it is preferred to utilize polyolefin and polyester polymers without additives other than flame retardants and dyes or pigments, it will be recognized that the individual polymers which are combined to make the carpet face yarn of the invention may contain any one or more additives selected from antioxidants, fillers, antistatic agents, melt processing aids, uv and thermal stabilizers, plasticizers, and the like.

Stabilizers useful with the polymers used to produce the conjugate filaments of the invention include, but are not limited to, calcium powders, calcium stearate, phenols and hindered phenols, zinc oxide, aryl esters, hydroxybenzophenone, hydroxybenzotriazole and the like.

Antioxidants may be selected from alkylated phenols and bisphenols, alkylidene-bisphenols, alkylidene-trisphenols, alkylidene polyphenols, thiophenols, dithio-bisphenols, dithio-trisphenols, thio-polyalkylated phenols, phenol condensation products, amines, dilauryl thiodipropionate, distearyl thiodipropionate, dimyristyl thiodipropionate, ditridecyl thiodipropionate, pentaerythritol tetrakis(β-lauryl thiopropionate), p-benzoquinone, 2,5-ditert-butylhydroquinone, and the like.

Having described the invention and its preferred embodiments, it will be recognized that the variations of the invention are within the spirit and scope of the appended claims.

What I claim is:

1. A carpet face yarn having a denier in the range of from about 1350 to about 1550 per 72 filaments consisting essentially of trilobal or delta cross-section filaments said filaments having a substantially continuous polyolefin phase containing a plurality of generally co-linear substantially discontinuous smaller elongate polyester fibrils embedded within the polyolefin phase wherein the polyester fibrils comprise from about 5 to about 40 wt. % and the polyolefin phase comprises from about 60 to about 95 wt. % of the filaments.

2. The carpet face yarn of claim 1 wherein the polyolefin is polypropylene.

3. The carpet face yarn of claim 2 wherein the polyester is polyethylene terephthalate.

4. The carpet face yarn of claim 2 wherein the polyester is polybutylene terephthalate.

5. The carpet face yarn of claim 1 wherein the polyester is a mixture of about 10 wt. % polyethylene terephthalate and about 5 wt. % polybutylene terephthalate.

6. The carpet face yarn of claim 1 wherein the filaments contain from about 10 to about 15 wt. % polyester and from about 85 to about 90 wt. % polyolefin.

7. A trilobal carpet face yarn made by a method which comprises blending from about 5 to about 40 wt % polyester pellets selected from the group consisting of polybutylene terephthalate, polyethylene terephthalate and mixtures thereof with from about 60 to about 95 wt. % polyolefin pellets, feeding the blend to a hot melt extruder to meet the mixture and to produce an essentially homogenous molten mixture of polyolefin and polyester and forcing the molten mixture at a shear rate within the range of from about 1000 to about 5000 reciprocal seconds through a spinnerette containing a plurality of trilobal capillary openings thereby producing filaments comprising a polyolefin/polyester matrix having a substantially continuous polyolefin phase and a substantially discontinuous polyester phase, said polyester phase consisting essentially of elongate polyester fibrils interspersed in the polyolefin phase.

8. The carpet yarn of claim 7 wherein the polyolefin is propylene.

9. The carpet yarn of claim 7 wherein the method therefor further comprises drawing the filaments three times and hot air texturizing the filaments, wherein both the drawing and texturizing are conducted at a temperature within the range of from about 120° to about 130° C.

10. The carpet yarn of claim 7 wherein the filaments contain from about 10 to about 15 wt. % polyester and from about 85 to about 90 wt. % polyolefin.

11. The carpet face yarn of claim 7 further comprising the step of dying the yarn with a disperse dye.

12. The carpet face yarn of claim 1 wherein each fibril has a diameter in the range of from a fraction of a micron to a few microns.

* * * * *

UNITED STATES PATENT AND TRADEMARK OFFICE

CERTIFICATE OF CORRECTION

PATENT NO. : 5,620,797

DATED : April 15, 1997

INVENTOR(S) : William C. Mallonee

It is certified that error appears in the above-indentified patent and that said Letters Patent is hereby corrected as shown below:

In the title of the patent: [54] after "Polyester" delete -- Conjugate --

Column 7, line 11, change "Barrex" to -- Bartex --.

Column 8, line 54, change "1004" to -- 100% --.

Column 8, line 58, change "1004" to -- 100% --.

Signed and Sealed this

Twenty-second Day of July, 1997

Bruce Lehman

*Attest:*

BRUCE LEHMAN

*Attesting Officer*

*Commissioner of Patents and Trademarks*